US007784114B2

(12) United States Patent
Kume et al.

(10) Patent No.: US 7,784,114 B2
(45) Date of Patent: Aug. 31, 2010

(54) MASCOT STORAGE TYPE SHORTS

(76) Inventors: Taeko Kume, 4555-1, Nagasao, Kawachimachi, Inashiki-gun, Ibaraki, 300-1312 (JP); Kiyoshi Kume, 4555-1, Nagasao, Kawachimachi, Inashiki-gun, Ibaraki, 300-1312 (JP)

( * ) Notice: Subject to any disclaimer, the term of this patent is extended or adjusted under 35 U.S.C. 154(b) by 143 days.

(21) Appl. No.: 11/630,607

(22) PCT Filed: Jun. 22, 2004

(86) PCT No.: PCT/JP2004/008740

§ 371 (c)(1),
(2), (4) Date: Nov. 29, 2007

(87) PCT Pub. No.: WO2005/077212

PCT Pub. Date: Aug. 25, 2005

(65) Prior Publication Data

US 2008/0196147 A1 Aug. 21, 2008

(51) Int. Cl.
*A41D 1/06* (2006.01)
*A41B 9/00* (2006.01)

(52) U.S. Cl. ..... 2/228; 2/238; 2/400; 2/403; 2/406

(58) Field of Classification Search ..... 2/400–408, 2/228, 227, 238, 69, 247–251; 383/4
See application file for complete search history.

(56) References Cited

U.S. PATENT DOCUMENTS

| | | | | | |
|---|---|---|---|---|---|
| 2,582,699 | A | * | 1/1952 | Jelaso et al. | 446/28 |
| 4,145,762 | A | * | 3/1979 | Wallach | 2/67 |
| 4,277,024 | A | * | 7/1981 | Spector | 239/36 |
| 4,404,689 | A | * | 9/1983 | DeWan | 2/247 |
| 4,674,135 | A | * | 6/1987 | Greene | 2/400 |
| 5,809,577 | A | * | 9/1998 | Getz | 2/406 |

FOREIGN PATENT DOCUMENTS

| | | |
|---|---|---|
| JP | 1-125307 | 8/1989 |

* cited by examiner

*Primary Examiner*—Gloria Hale
(74) *Attorney, Agent, or Firm*—Jordan and Hamburg LLP

(57) ABSTRACT

Mascot type storage shorts that are compact at time of carrying, enable sanitary storage, and have excellent fashionability include a mascot-shaped body which is sewn or otherwise attached to any one of the front panel, rear panel or waist portion of a shorts main body, and the shorts main body can be stored through a storage port provided on the rear surface of the mascot-shaped body. The mascot-shaped body is produced as a mascot in the shape of a doll, flower, animal or other motif, and in consideration of convenience at time of carrying, a locking mechanism enables the mascot type storage shorts to be hung from a key holder or the like.

6 Claims, 8 Drawing Sheets

MASCOT STORAGE TYPE SHORTS

BACKGROUND OF THE INVENTION

The present invention relates to shorts enabling the storage of the shorts main body in the interior of a mascot-shaped body integrally formed on the outer surface of the shorts main body. More specifically, it relates to shorts for use by women to thereby provide excellent hygiene at a time of carrying and excellent fashionability.

Conventionally, an extra pair of shorts carried when a person is going out, in particular, underwear for women, has been carried in a handbag or a pouch. When shorts are carried in a handbag, there may be times when the handbag is opened and the shorts are inadvertently seen by another person or the person carrying the shorts are subject to similar embarrassing concerns. When a pouch for holding shorts is used, there is the problem of an increase in belongings to be carried.

Further, with regard to form at time of carrying, shorts are known that are provided with a pocket for storing the entire shorts therewithin. In another proposal, the shorts themselves are folded a number of times and vacuum packaged. These types of shorts are disclosed, for example, in the following patent documents 1-3.

Patent document 1: JP 2000-282301 A
Patent document 2: JP 2000-328301 A
Patent document 3: H8-158107 A However, conventionally, given the nature of shorts to be carried, there has been a tendency to put emphasis only on necessity and functionality. In particular, consideration has not been given to any pleasure in carrying the shorts, or to fashion sense.

It is an object of the present invention to provide mascot-type storage shorts that can be carried in a compact and sanitary manner and have excellent fashionability.

SUMMARY OF THE INVENTION

To achieve the above object, the mascot-type storage shorts relating to the invention comprises a shorts main body having a front panel, rear panel and waist portion, and a mascot-shaped body integrally formed with any of the front panel, rear panel or waist portion, and having a shorts main body storage portion, wherein the mascot-shaped body is produced in the form of a doll, flower, animal, tool, brand mark or other motif, and is provided with a storage port on the rear surface thereof for putting in or taking out the shorts main body.

In accordance with a further embodiment of the invention, a portion of the cloth forming the rear surface of the mascot-shaped body is formed so as to overlap.

In another embodiment of the invention, the shorts main body is sewn to the interior of the storage portion of the mascot-shaped body.

In accordance with another embodiment the mascot-shaped body is provided with a bag containing an aromatic agent.

In yet another embodiment, the mascot-shaped body is provided with locking means, and a pendant holder is attached to said locking means.

In accordance with the invention, because a mascot-shaped body having a shorts main body storage portion is provided, an extra pair of shorts, which is an essential item for women, can be carried in a sanitary and compact manner. Further, even if this is inadvertently seen by another person when a handbag is opened, such person will see only the pleasing external image of the mascot-shaped body, so there will be no cause for embarrassment. Further, because the mascot-shaped body is produced in the form of a doll, flower, animal or other motif, it has excellent fashion sense and gives a feeling of playfulness.

Because the mascot-shaped body has a storage port on the rear surface thereof, the storage port can be produced without harming the design of the mascot-shaped body itself, and the processing thereof is easy. Because the location for disposition of the mascot-shaped body is not limited to any specific position on the shorts main body outer surface, the mascot-shaped body can be used with a great variety of types of shorts, and because of the high degree of freedom in design, it can be produced in the form of a great variety of motifs. As a result, the mascot-shaped body can be adapted to a wide range of tastes, and can offer users the pleasures of collecting and other such hobbies.

In accordance with a further development of the invention, the shorts main body storage port provided on the mascot-shaped body is characterized only in that it is partially overlapping. For this reason, there is a high degree of freedom in the design with respect to the shape (size) of the storage port, and the mascot-shaped body has high producibility. Further, because no metal or fasteners are used for the storage port, the shorts retain a gentle feel against the skin and will not be the cause of inflammation of the skin or other such discomfort, and thus will be comfortable to wear.

In accordance with another embodiment, because a portion of the shorts main body is sewn to the interior of the storage portion of the mascot-shaped body, regardless of their shape, the shorts main body and mascot-shaped body can be easily made integral. Further, even if at time of putting on or taking off the shorts, a strong force is inadvertently applied to the mascot-shaped body, it will not come off because it is attached with sufficient strength. Further, because during use of the mascot storage type shorts as a mascot the shorts will not be accidentally dropped or lost, there will be good durability in the use of the mascot storage type shorts themselves.

In accordance with a still further embodiment, because the mascot-shaped body is provided with a bag containing an aromatic agent, a sense of cleanliness, a sense of refreshment, a relaxation effect and other such effects can be attained.

In an advantageous embodiment in accordance with the invention, because the mascot-shaped body is provided with locking means, convenience at time of carrying is achieved.

DETAILED DESCRIPTION OF THE INVENTION

Figure 1:
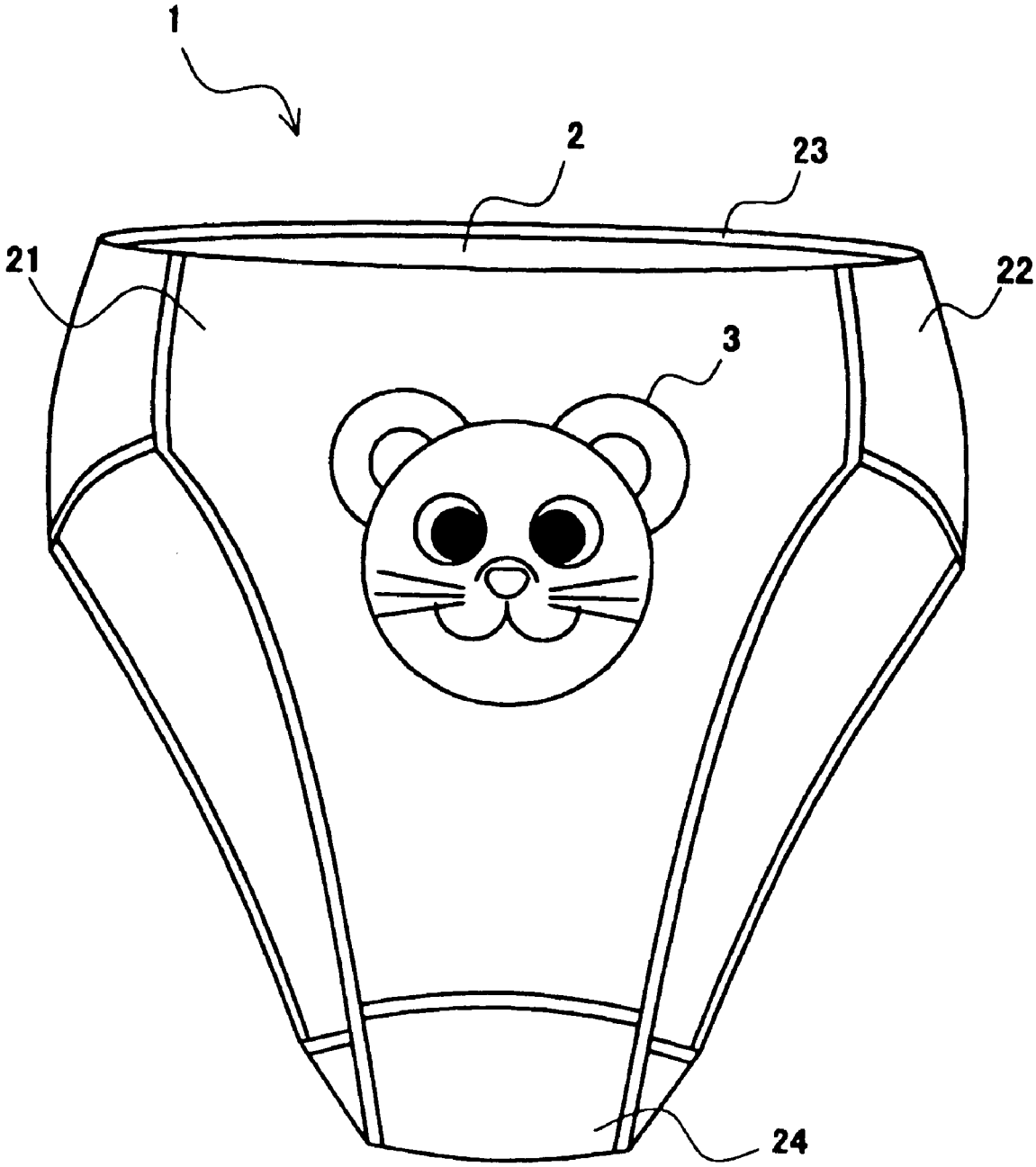
FIG. 1 is a plan view showing an embodiment of the mascot-type storage shorts relating to the present invention.
Figure 2:
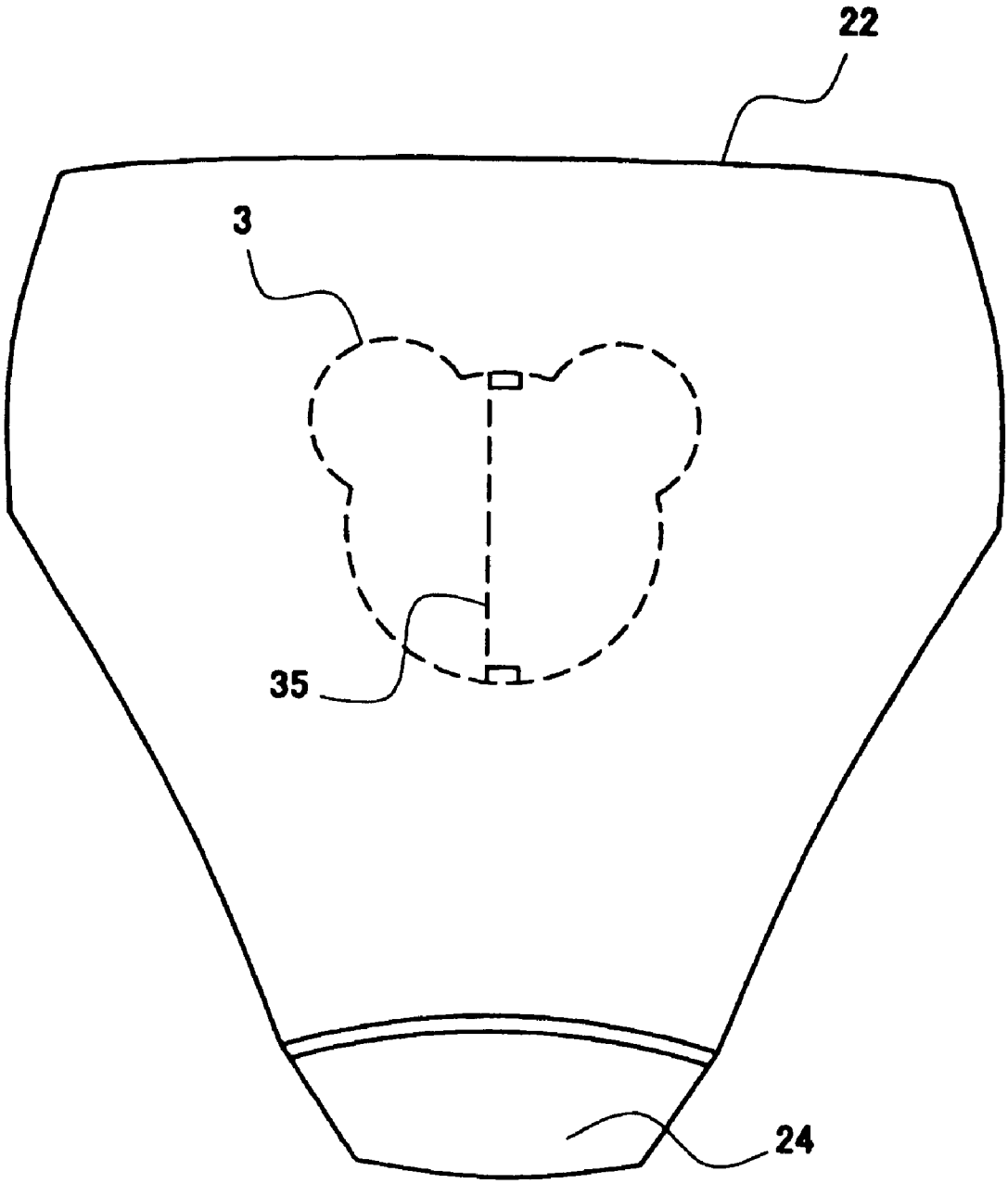
FIG. 2 is a rear view of mascot-type storage shorts.

The present invention is realized by integrating the mascot-shaped body with the outer surface of any of the front panel, rear panel or waist portion of the shorts main body, making the interior of this mascot-shaped body capable of storing the shorts main body, and providing for utility at time of carrying and fashionability. Referring now to a first embodiment, as seen in FIGS. 1 and 2, the mascot-type storage shorts 1 comprise a shorts main body 2 and a mascot-shaped body 3. The shorts main body 2 has a front panel 21, rear panel 22, waist portion 23 and crotch portion 24. The mascot-shaped body 3 is formed in a mascot shape in a motif of a doll, flower, tool, brand mark or the like.

Figure 3:
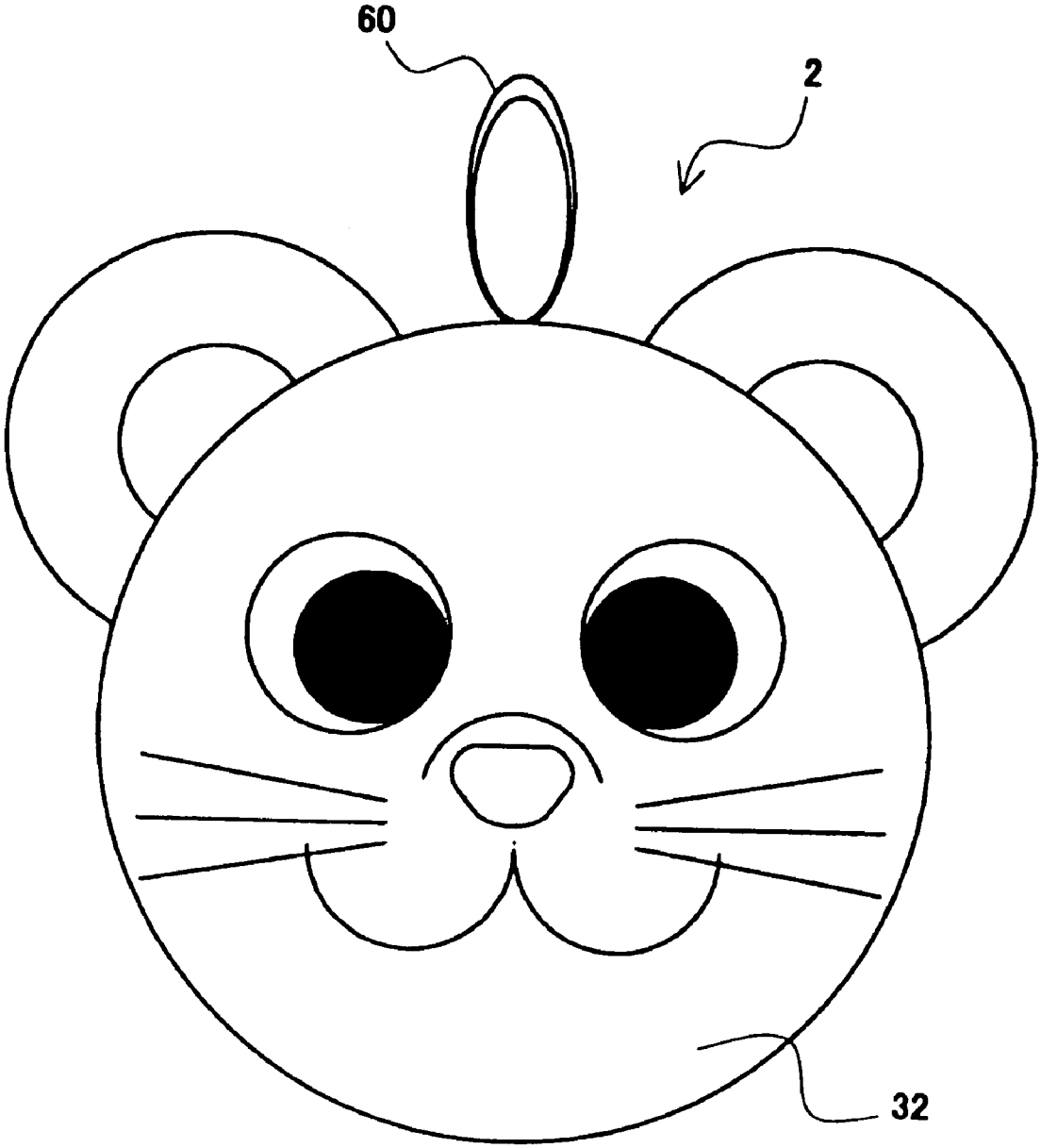
FIG. 3 is a front view of a mascot-shaped body.
Figure 4:
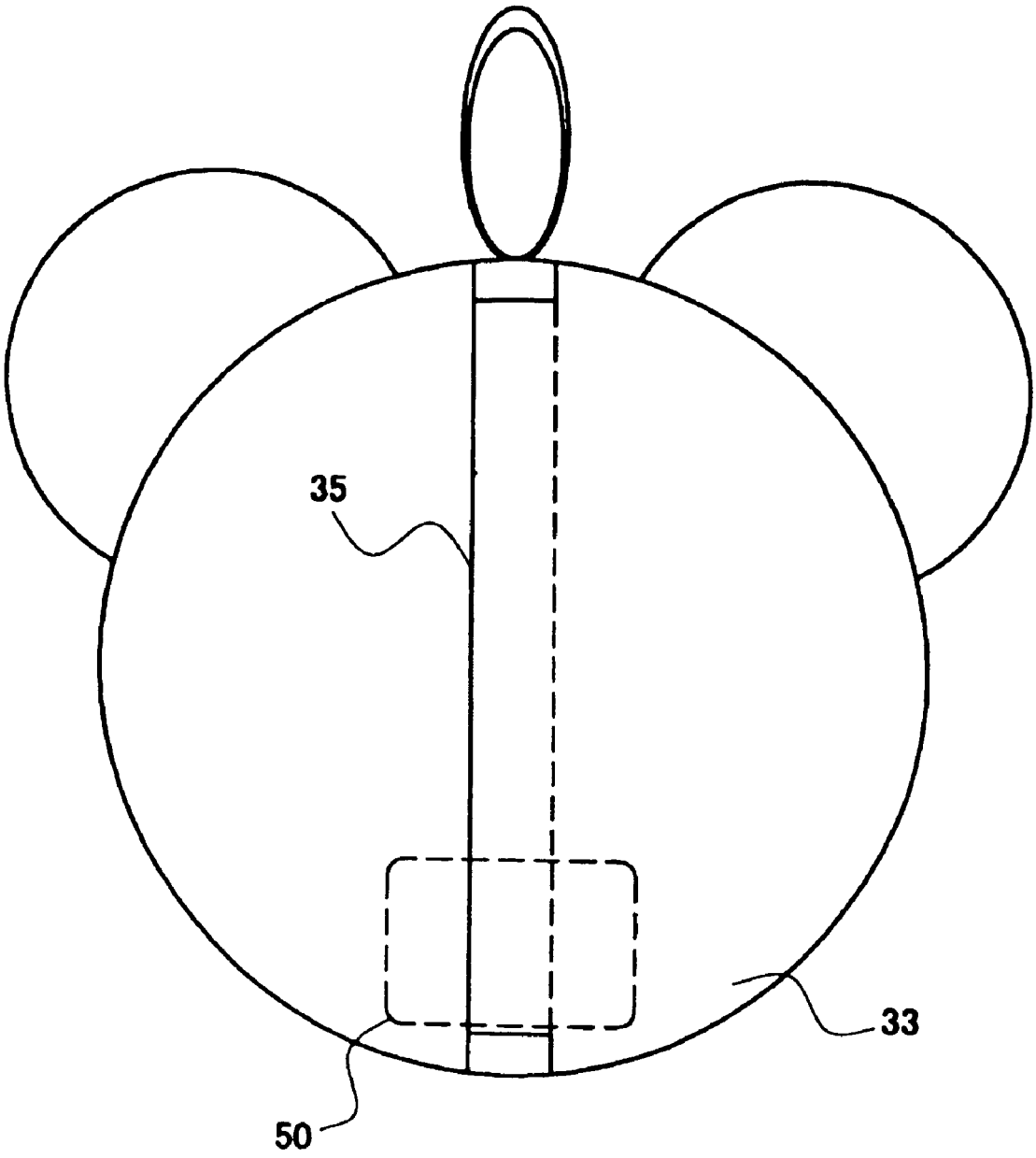
FIG. 4 is a rear view of a mascot-shaped body.
Figure 5:
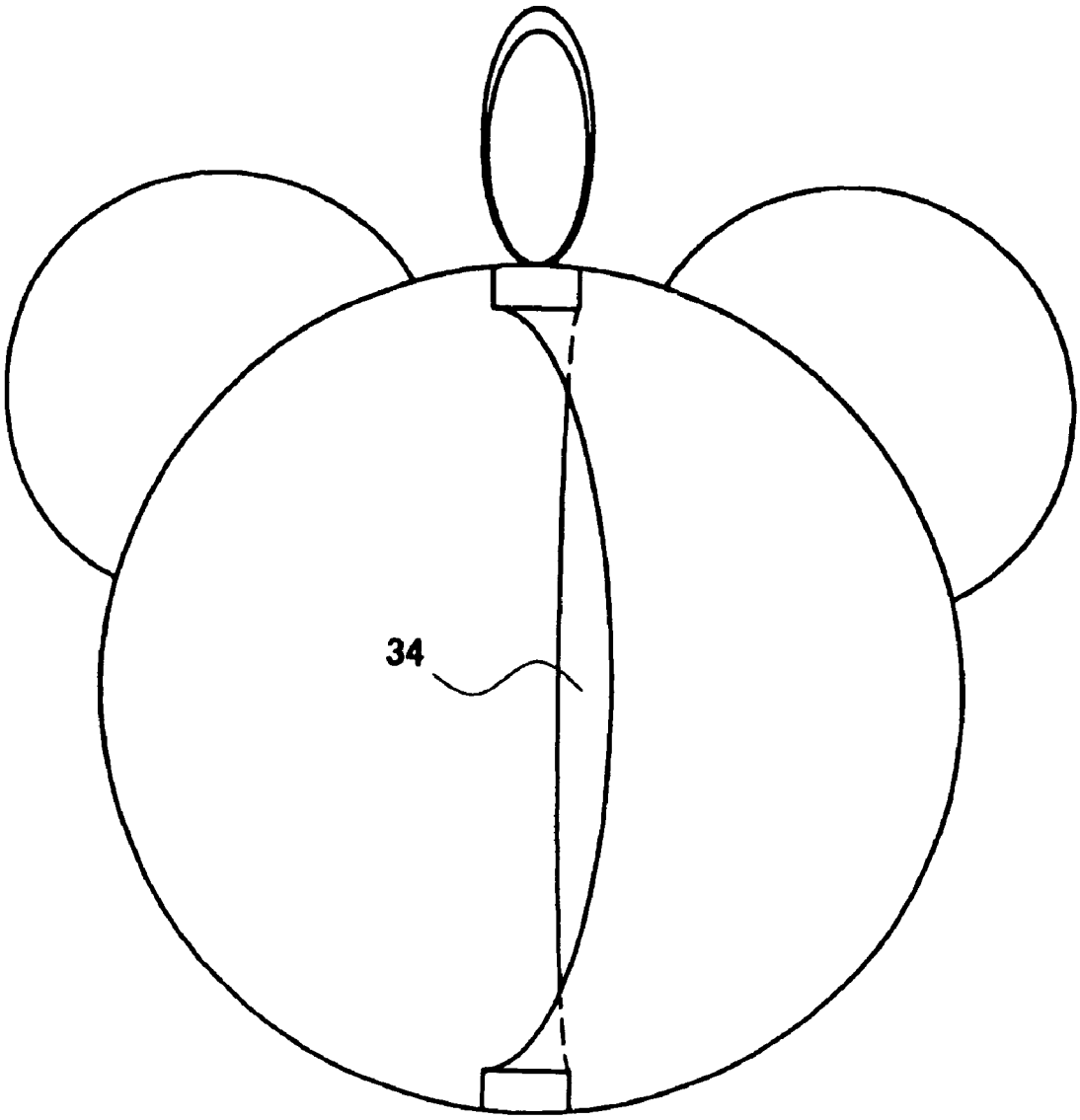
FIG. 5 is a rear view showing the shorts storage port in an open state.

As seen in FIGS. 3 and 4, the mascot-shaped body 3 is constituted by a front part 32 and a rear part 33 sewn together at an edge 37, forming a space 34 in which the shorts main body 2 can be stored. The mascot-shaped body 3 is integrated with the shorts main body 2 by sewing it to the outer surface of any of the front panel 21, rear panel 22 or waist part 23. A storage port 35 for storing the shorts main body 2 is provided at the rear surface of the mascot-shaped body 3. As shown in FIG. 5, this storage port 35 is configured such that a portion of the cloth constituting the rear surface of the mascot-shaped body 3 is overlapping.

Figure 6:
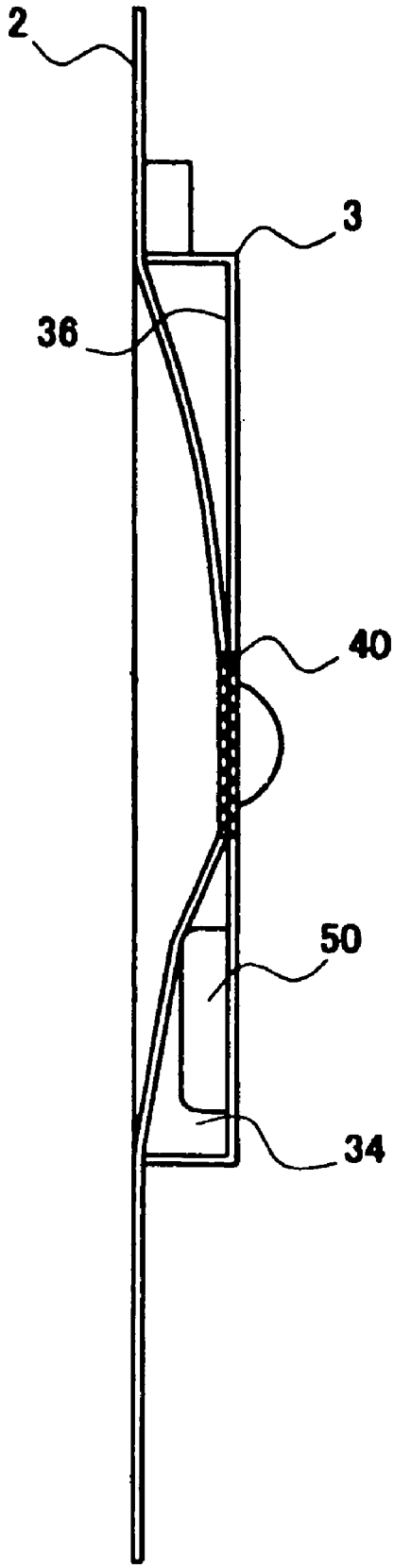
FIG. 6 is a cross-sectional view of the shorts main body and the mascot-shaped body.

As shown in FIG. 6, to store the shorts main body 2 fully within the space 34, a portion of the shorts main body 2 is attached to an inner surface 36 of the mascot-shaped body 3 by a sewn-together portion 40, thereby integrating the shorts main body 2 and the mascot-shaped body 3. For this sewn-together portion 40, a sewing method is selected that is appropriate in light of the shape of the mascot-shaped body 3, with respect to the area of the shorts main body 2 to be sewed thereto and the thread material to be used. In this manner, storage of the shorts main body 2 is not hindered and sufficient strength is given so that the mascot-shaped body 3 does not fall off.

Figure 7:
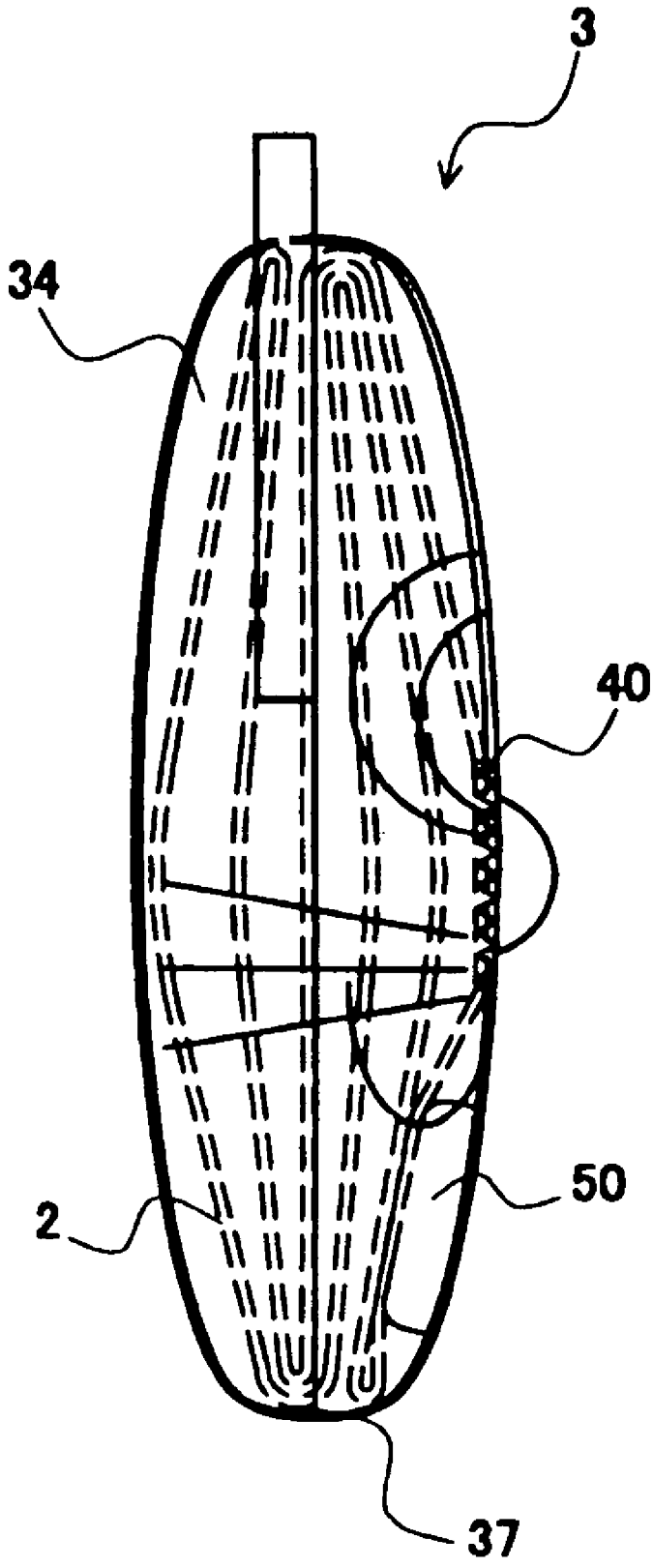
FIG. 7 is a lateral view showing the mascot storage type shorts main body 2 in a stored state.

When the present invention is used as a mascot, the shorts main body 2 is folded or otherwise made small, the storage port 35 at the rear panel of the mascot-shaped body 3 is opened, and the shorts main body 2 is passed therethrough and fully stored within the space 34, which is the shorts storage portion. As shown in FIG. 7, the space 34 is caused to expand by the volume of the shorts main body 2, causing the mascot-shaped body to become rounded and present the shape of a mascot.

A pendant holder 60 is provided to the mascot-shaped body 3. This configuration enables the mascot-shaped body, at time of carrying, to be carried hanging from a bag or the like. In this embodiment, an explanation was given for locking means as a ring-shaped pendant holder at the upper portion of the mascot-shaped body. The shape of the pendant holder is not limited to a ring shape, and a chain, clip, pin or other such construction may be selected as appropriate. Moreover, the attachment location is not limited to the top, but attachment can be made to the rear portion or other location in light of convenience at time of carrying.

Preferably, as shown in FIGS. 4 and 6, a fragrance pouch 50 is provided in the space 34 of the mascot-shaped body 3. During use as a mascot or use as shorts, the fragrance pouch 50 gives off a faint scent, providing a clean and refreshing feel. The fragrance pouch 50 is removable, and the aromatic agent can be supplemented or replaced. Depending on use conditions and preferences of the user, the fragrance pouch 50 can be removed so that the mascot-shaped body is used with no fragrance. The form and shape of the fragrance pouch 50 is not limited to a pouch, and a variety of configurations may be used, including soaking an aromatic into the fabric or weaving it into the fibers.

Figure 8:
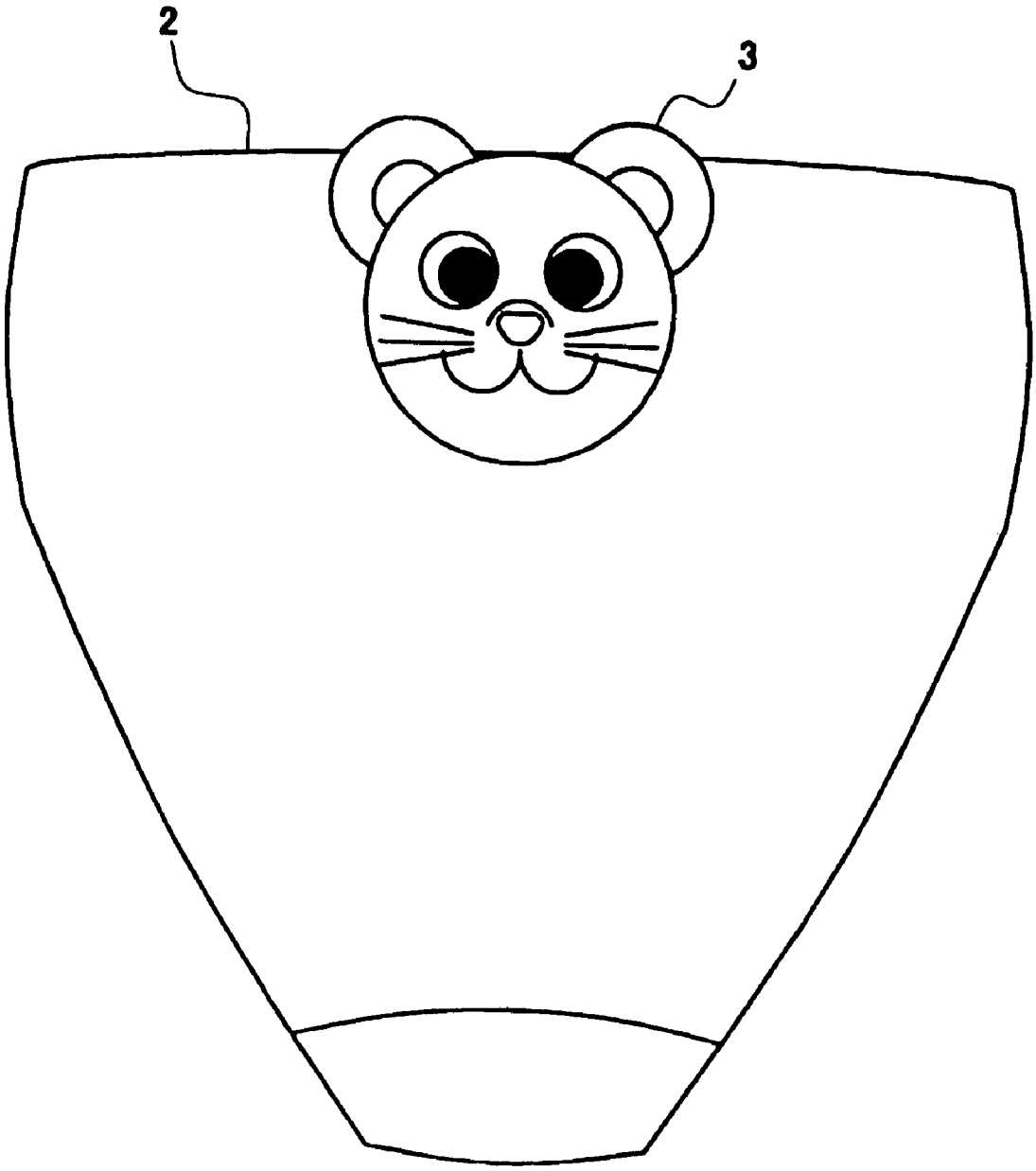
FIG. 8 is a plan view showing another embodiment relating to the attachment position for the mascot-shaped body.

In this embodiment, an explanation was given of a configuration where the mascot-shaped body 3 is attached roughly in the center of the front panel 21, but the present invention is not limited to such a configuration. For example, as shown in FIG. 8, the mascot-shaped body 3 may be disposed at the waist part 23 of the shorts main body 2 or at the rear panel 22 (not shown in the drawing), and such configurations may be selected as appropriate.

Further, in this embodiment, the storage port is provided in the center of the rear surface of the mascot-shaped body 3, but the present invention is not limited to such a configuration. The shape of the storage port may be changed to match a motif of the mascot-shaped body 3, and the opening may be horizontal or slanted or otherwise, with the shape to be decided in consideration of design and function.

EXPLANATION OF THE LEGENDS

1: Mascot storage type shorts
2: Shorts main body
3: Mascot shaped body
35: Storage port
40: Sewed-together portion
50: Fragrance pouch
60: Pendant holder

The invention claimed is:

1. Storable shorts, comprising:

a main body having a front panel, a rear panel and a waist portion; and a storage body formed separately from the main body, said storage body presenting a shape representative of a motif, the storage body including a front portion and a rear portion stitched to one another at a mutual periphery to define a space therebetween in which the main body is receivable, said rear portion including a storage port through which the space is accessible for insertion and removal of the main body respectively into and out of the space, the storage port being configured so that a portion of material forming the rear portion overlaps a remaining portion forming the rear portion, a partial area of an outer surface of either of the front panel or the rear panel of the main body being integrally attached by sewing to one section only of an inner surface of the front portion within the space, in a position corresponding to the storage port.

2. The storable shorts according to claim 1, wherein the motif includes any one of a doll, flower, animal or brand mark.

3. The storable shorts according to claim 1, wherein the storage body is provided with a pouch containing an aromatic agent.

4. The storable shorts according to claim 1, wherein the storage body is provided with a pouch containing an aromatic agent.

5. The storable shorts according to claim 1, wherein the storage body is provided with a pendant holder.

6. The storable shorts according to claim 3, wherein the storage body is provided with a pendant holder.

* * * * *